US011790746B2

(12) United States Patent
Gadonniex et al.

(10) Patent No.: US 11,790,746 B2
(45) Date of Patent: Oct. 17, 2023

(54) SMOKE ENTRY SOLUTION FOR MULTI WAVE MULTI ANGLE SAFETY DEVICE

(71) Applicant: Carrier Corporation, Palm Beach Gardens, FL (US)

(72) Inventors: Dennis Michael Gadonniex, Bradenton, FL (US); Kenneth J. Mott, Colorado Springs, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/581,401

(22) Filed: Jan. 21, 2022

(65) Prior Publication Data

US 2022/0246009 A1 Aug. 4, 2022

Related U.S. Application Data

(60) Provisional application No. 63/144,724, filed on Feb. 2, 2021.

(51) Int. Cl.
*G08B 17/103* (2006.01)
*G08B 17/113* (2006.01)

(52) U.S. Cl.
CPC ..... *G08B 17/103* (2013.01); *G08B 17/113* (2013.01)

(58) Field of Classification Search
CPC ..... G08B 17/103; G08B 17/113
See application file for complete search history.

(56) References Cited

U.S. PATENT DOCUMENTS 4,539,556 A * 9/1985 Dederich ..... G08B 29/145 340/630
5,719,557 A * 2/1998 Rattman ..... G08B 17/113 73/304 R
5,751,218 A * 5/1998 Winterble ..... G08B 17/107 340/630
6,351,219 B1 * 2/2002 Tanguay ..... G08B 17/107 340/630

(Continued)

FOREIGN PATENT DOCUMENTS

CN 106056830 A 10/2016
CN 110097731 A 8/2019

(Continued)

OTHER PUBLICATIONS

United Kingdom Office Action; United Kingdom Application No. 2201324.7; dated Mar. 23, 2022; 11 pages.

*Primary Examiner* — Hoi C Lau
(74) *Attorney, Agent, or Firm* — CANTOR COLBURN LLP

(57) ABSTRACT

An optical chamber assembly of a life safety device includes a light ring for supporting at least one light device and an optical cover defining an interior chamber of the optical chamber assembly. The optical cover has a plurality of side members spaced from one another to define a plurality of smoke flow paths connected to the interior chamber. A light cover is disposed between the light ring and the optical cover and optically couples the at least one light device with the interior chamber. A primary smoke entry location is defined by at least one of the plurality of smoke flow paths in the optical cover and a secondary smoke entry location distinct from the primary smoke entry location is arranged in fluid communication with the interior chamber.

19 Claims, 9 Drawing Sheets

(56) References Cited

U.S. PATENT DOCUMENTS

| | | | | |
|---|---|---|---|---|
| 6,778,091 | B2 * | 8/2004 | Qualey, III | G08B 17/107 340/630 |
| 7,034,702 | B2 * | 4/2006 | Thomas | G08B 17/107 356/438 |
| 7,365,846 | B2 * | 4/2008 | Hess | G08B 17/113 356/337 |
| 7,697,140 | B2 * | 4/2010 | Iguchi | G08B 17/107 340/630 |
| 8,106,784 | B2 * | 1/2012 | Katou | G08B 17/113 340/630 |
| 8,816,867 | B2 * | 8/2014 | Mammoto | G08B 17/113 340/630 |
| 8,970,387 | B2 * | 3/2015 | Brigham | G08B 17/113 340/630 |
| 9,007,222 | B2 * | 4/2015 | Mittleman | H04L 12/6418 340/693.11 |
| 9,460,600 | B2 * | 10/2016 | Mittleman | G01N 21/84 |
| 9,704,365 | B2 * | 7/2017 | Brigham | G01J 5/0853 |
| 9,779,604 | B2 * | 10/2017 | Mittleman | G08B 17/113 |
| 10,019,879 | B2 * | 7/2018 | Cruse | G08B 17/113 |
| 10,024,782 | B2 * | 7/2018 | Lo | G08B 17/107 |
| 10,151,693 | B2 * | 12/2018 | Iguchi | G01N 21/53 |
| 10,234,388 | B2 * | 3/2019 | Ebata | G08B 17/117 |
| 10,282,956 | B2 * | 5/2019 | Stibich | G08B 17/107 |
| 2009/0009345 | A1 * | 1/2009 | Conforti | G08B 17/107 340/627 |
| 2015/0170489 | A1 * | 6/2015 | Mittleman | H04L 12/6418 340/629 |
| 2020/0160688 | A1 * | 5/2020 | Shimadzu | G01N 21/01 |
| 2022/0246009 | A1 * | 8/2022 | Gadonniex | G08B 17/103 |

FOREIGN PATENT DOCUMENTS

| | | | |
|---|---|---|---|
| CN | 110675590 | A | 1/2020 |
| CN | 111080958 | A | 4/2020 |
| CN | 111564019 | A | 8/2020 |
| CN | 111627182 | A | 9/2020 |
| CN | 211956682 | U | 11/2020 |
| CN | 211956683 | U | 11/2020 |
| CN | 212009806 | U | 11/2020 |
| EP | 1146492 | A2 | 10/2001 |
| EP | 1903524 | B1 | 11/2009 |
| EP | 2402920 | A2 | 1/2012 |
| EP | 2908301 | A1 | 8/2015 |
| EP | 2685437 | B1 | 2/2016 |
| EP | 3042365 | B1 | 3/2018 |
| JP | 3938750 | B2 | 6/2007 |
| JP | 6709725 | B2 | 6/2020 |
| WO | 2019217579 | A1 | 11/2019 |
| WO | 2020003712 | A1 | 1/2020 |
| WO | 2020004031 | A1 | 1/2020 |

* cited by examiner

SMOKE ENTRY SOLUTION FOR MULTI WAVE MULTI ANGLE SAFETY DEVICE

CROSS-REFERENCE TO RELATED APPLICATIONS

This application claims the benefit of U.S. Provisional Application No. 63/144,724 filed Feb. 2, 2021, the disclosure of which is incorporated herein by reference in its entirety.

BACKGROUND

Embodiments disclosed herein relate to a life safety device and, more particularly, to a photo-electric life safety device using multiple light emitters and receivers.

A smoke detector or alarm is a life safety device that detects smoke and issues an alarm. A photoelectric smoke alarm, meanwhile, is a type of smoke alarm emitter, a light receiver and an optic chamber. When there is no smoke in the optic chamber and the optic chamber is empty or mostly empty, the light receiver typically receives a small amount of light reflected from chamber surfaces. On the other hand, when smoke is present in the optic chamber, the light receiver receives more light due to that light being reflected from the smoke particles. When an amount of the received light exceeds a predetermined level, an alarm is triggered.

Existing residential smoke alarms have various components surrounding the optic chamber which can inhibit the flow of smoke into the optic chamber. Accordingly, there is a need for a smoke alarm that allows for an increased smoke flow into the optic chamber.

BRIEF DESCRIPTION

According to an embodiment, an optical chamber assembly of a life safety device includes a light ring for supporting at least one light device and an optical cover defining an interior chamber of the optical chamber assembly. The optical cover has a plurality of side members spaced from one another to define a plurality of smoke flow paths connected to the interior chamber. A light cover is disposed between the light ring and the optical cover and optically couples the at least one light device with the interior chamber. A primary smoke entry location is defined by at least one of the plurality of smoke flow paths in the optical cover and a secondary smoke entry location distinct from the primary smoke entry location is arranged in fluid communication with the interior chamber.

In addition to one or more of the features described above, or as an alternative, in further embodiments the secondary smoke entry location is arranged at an outer aspect of the optical chamber assembly.

In addition to one or more of the features described above, or as an alternative, in further embodiments the secondary smoke entry location is defined by an opening.

In addition to one or more of the features described above, or as an alternative, in further embodiments the opening is formed between at least one of the plurality of side members and a surface of the light cover.

In addition to one or more of the features described above, or as an alternative, in further embodiments the optical cover further comprises an end piece and the opening is formed between at least one of the plurality of side members and the end piece.

In addition to one or more of the features described above, or as an alternative, in further embodiments the light cover includes a body having a sidewall and the opening is formed within the sidewall.

In addition to one or more of the features described above, or as an alternative, in further embodiments the opening is formed between a portion of the light cover and the light ring.

In addition to one or more of the features described above, or as an alternative, in further embodiments the light cover includes a body having a sidewall and the light ring includes a ring body, the opening being formed between a portion of the sidewall of the light cover that is offset from an adjacent surface of the ring body.

In addition to one or more of the features described above, or as an alternative, in further embodiments the at least one light device includes a light source and a light receiver.

In addition to one or more of the features described above, or as an alternative, in further embodiments the optical chamber assembly is mounted to a printed circuit board and the light cover removably couples the light ring directly to the printed circuit board.

In addition to one or more of the features described above, or as an alternative, in further embodiments the optical cover is connected to the light cover via a snap fit connection.

According to another embodiment, a life safety device includes a printed circuit board and an optical chamber assembly connected to the printed circuit board and at least one light device for evaluating particles within the inside the optical chamber assembly. The optical chamber assembly has a primary smoke entry location and a secondary smoke entry location distinct from the primary smoke entry location.

In addition to one or more of the features described above, or as an alternative, in further embodiments the secondary smoke entry location is arranged about an outer aspect of the optical chamber assembly.

In addition to one or more of the features described above, or as an alternative, in further embodiments the optical chamber assembly comprises a light ring for supporting the at least one light device, an optical cover defining an interior chamber of the optical chamber assembly, and a light cover disposed between the light ring and the optical cover, wherein the light cover optically couples the at least one light device with the interior chamber.

In addition to one or more of the features described above, or as an alternative, in further embodiments the optical cover further comprises a plurality of side members spaced from one another to define a plurality of smoke flow paths connected to the interior chamber and the primary smoke entry location is defined by at least one of the plurality of smoke flow paths.

In addition to one or more of the features described above, or as an alternative, in further embodiments the secondary smoke entry location is defined by an opening formed between at least one of the plurality of side members and a surface of the light cover.

In addition to one or more of the features described above, or as an alternative, in further embodiments the optical cover further comprises an end piece and the secondary smoke entry location is defined by an opening formed between at least one of the plurality of side members and the end piece.

In addition to one or more of the features described above, or as an alternative, in further embodiments the light cover includes a body having a sidewall and the secondary smoke entry location is defined by an opening formed within the sidewall.

In addition to one or more of the features described above, or as an alternative, in further embodiments the secondary smoke entry location is defined by an opening formed between a portion of the light cover and the light ring.

In addition to one or more of the features described above, or as an alternative, in further embodiments the secondary smoke entry location is defined by an opening, and the opening includes a mesh material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

A photo-electric smoke alarm with an electrically conductive optics chamber having a high flame rating, capable of absorbing stray radiation from both light sources and external ambient light, and electrically insulating an adjacent printed circuit board is described.

Figure 1:
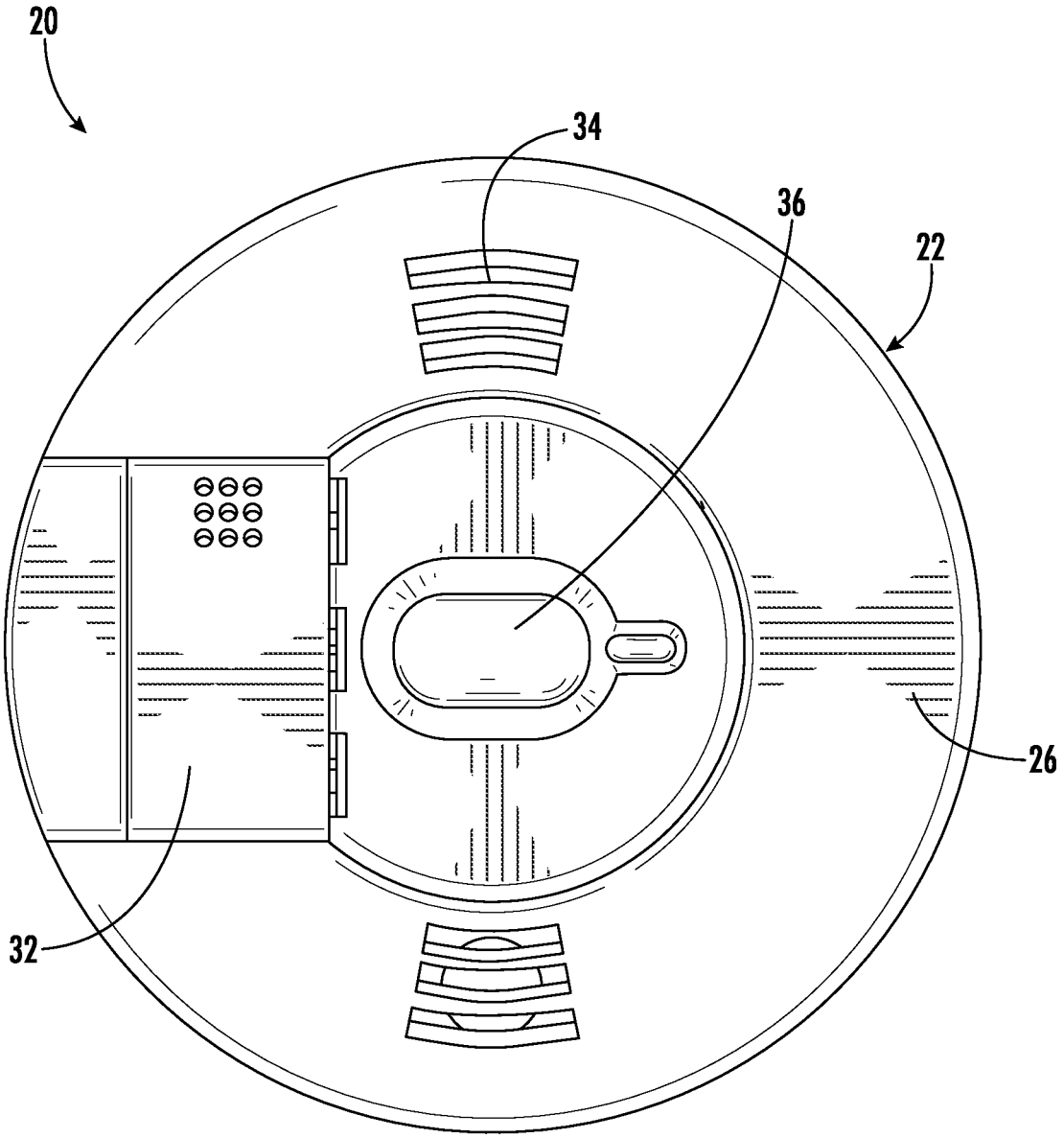
FIG. 1 is a plan view of an example of a life safety device.
Figure 2:
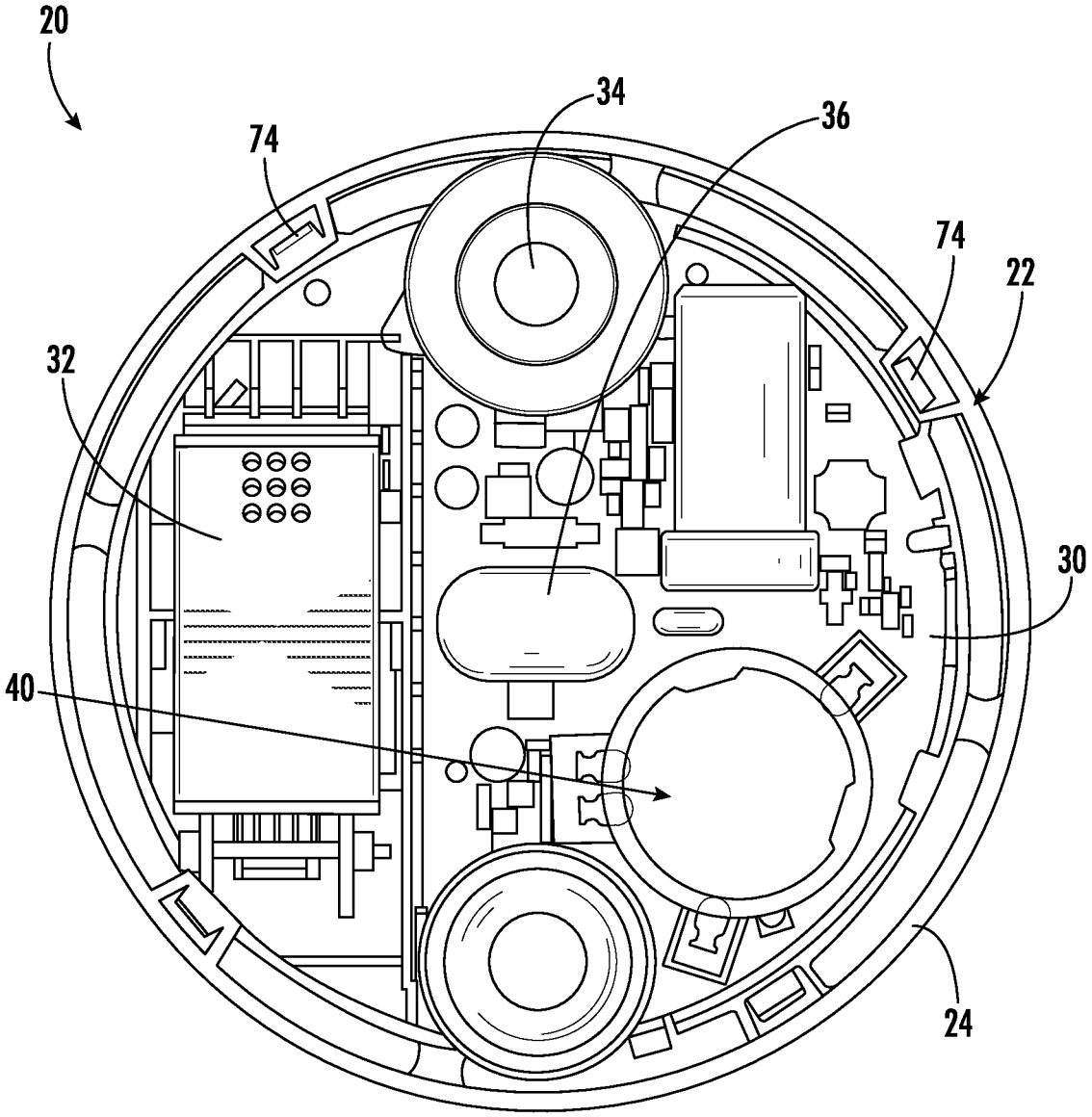
FIG. 2 is a plan view of the life safety device of FIG. 1 with the lower portion of the housing removed according to an embodiment.
Figure 3A:
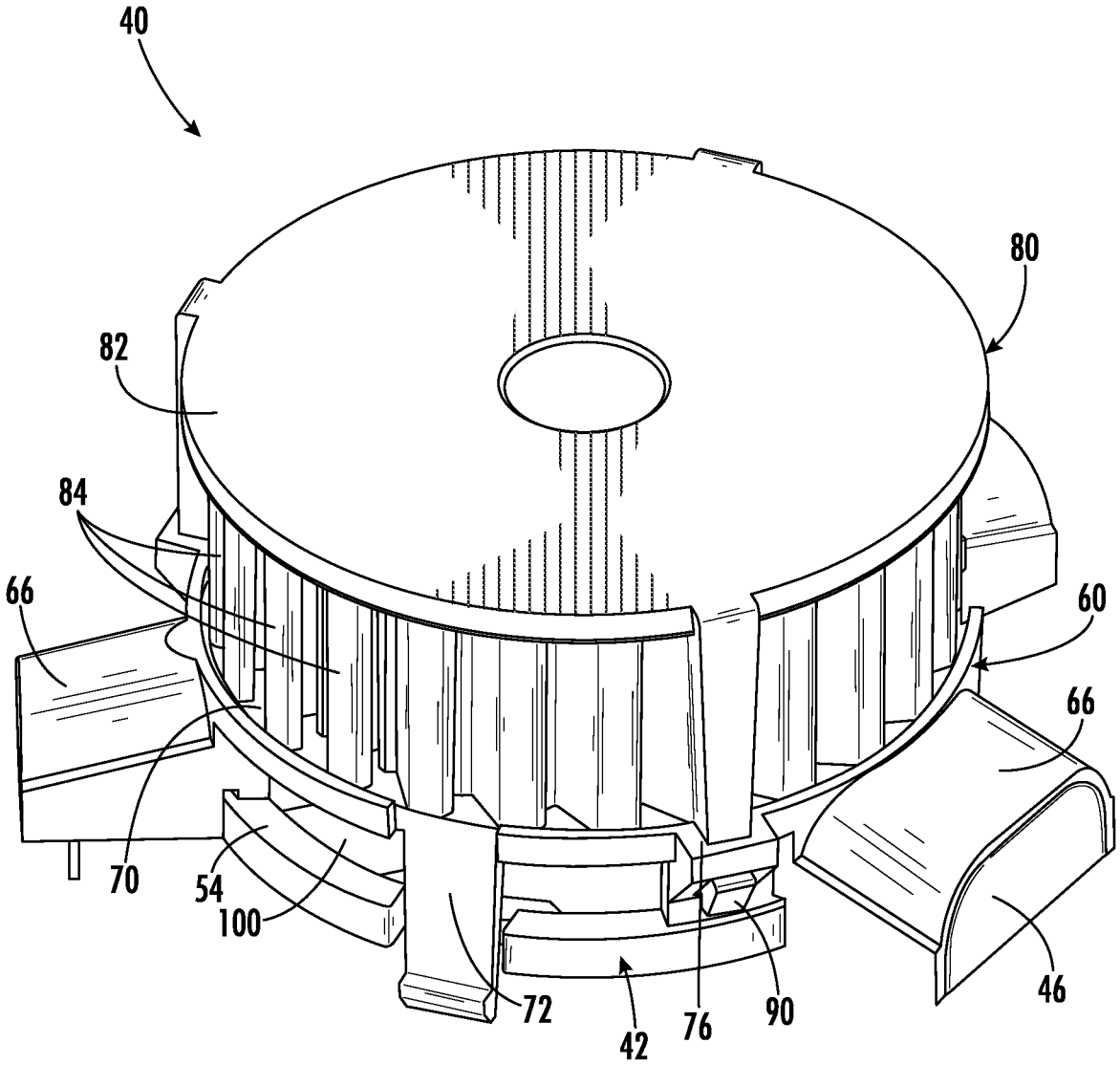
FIG. 3A is a top perspective view of an optical chamber assembly of a life safety device according to an embodiment.
Figure 3B:
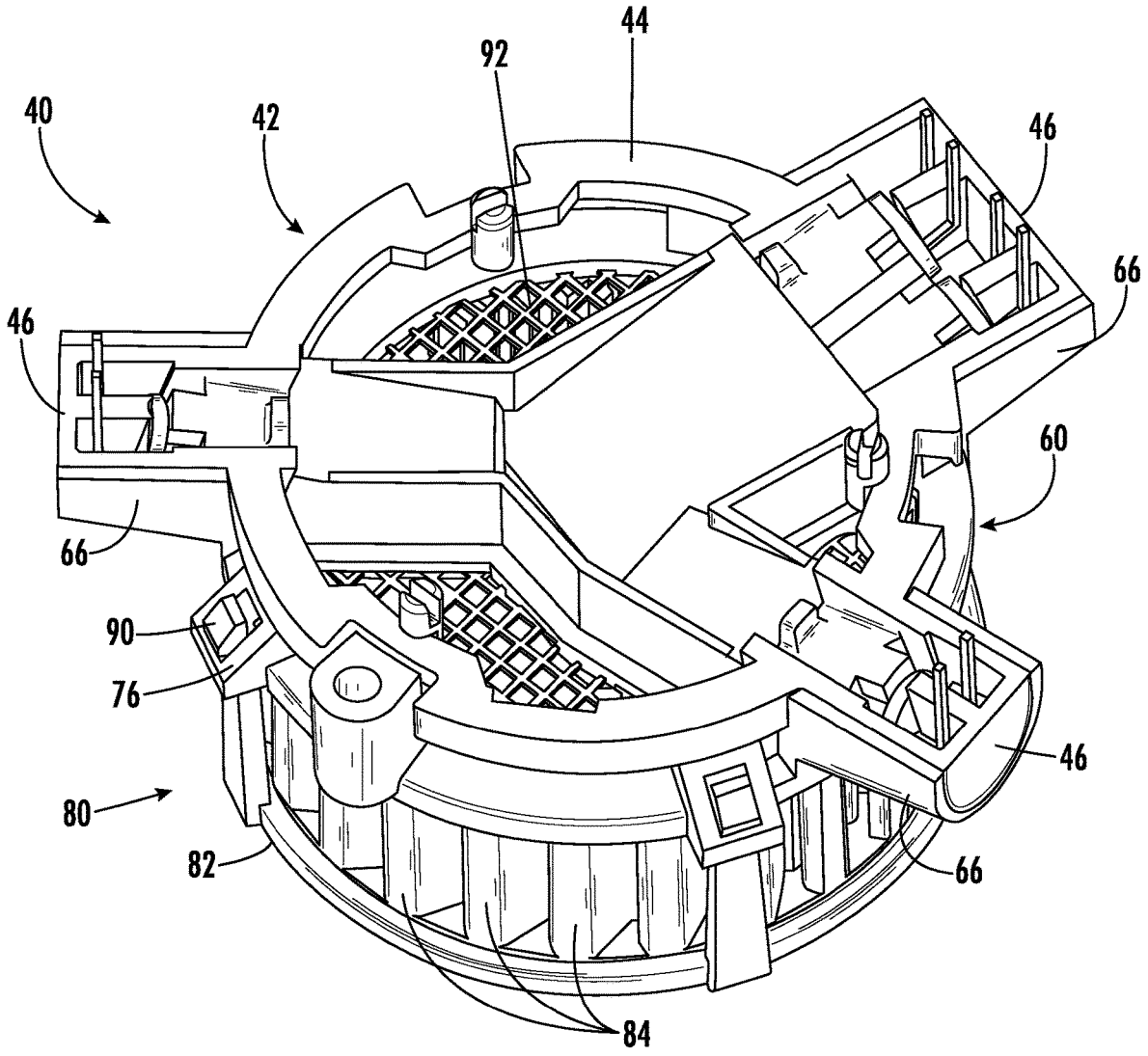
FIG. 3B is a bottom perspective view of the optical chamber assembly of FIG. 3A according to an embodiment.

With reference now to FIGS. 1 and 2, an example of a life safety device 20, such as a photo-electric smoke alarm or detector for example, is illustrated. As shown, the life safety device 20 includes a housing 22 including a first upper housing portion 24 (best shown in FIG. 2) and a second, lower housing portion 26 that is removably connected to the first housing portion 24. When the first and second housing portions 24, 26 are connected, the first and second housing portions 24, 26 enclose the controls and other components necessary for operation of the life safety device 20. As used herein, the terms "upper", "lower", and the like are in reference to the life safety device 20 in use as it is mounted on a surface, such as a ceiling in a building for example. Therefore, the upper housing portion 24 is typically closer to the ceiling than the lower housing portion 26, and the lower housing portion 26 is typically the portion of the life safety device 20 that will face downward toward the floor of the building. In some embodiments, the life safety device 20 may be mounted on a wall such that upper housing portion 24 is closer to the wall than the lower housing portion 26, and the lower housing portion 26 is typically the portion of the life safety device 20 that will face outward toward the interior space of the room or space to be monitored.

The life safety device 20 further includes controls including a printed circuit board 30 disposed within the upper housing portion (best shown in FIG. 2). The printed circuit board 30 includes the circuitry and/or components associated with at least one detection circuit (not shown) and at least one alarm circuit (not shown). In some embodiments, the life safety device 20 may be hardwired to a power source (not shown) located within the building or area where the life safety device 20 is mounted, remote from the life safety device 20. In such embodiments, the printed circuit board 30 may be directly or indirectly connected to the power source. In an embodiment, the life safety device 20 may include a compartment 32 for receiving one or more batteries sufficient to provide the power necessary to operate the life safety device 20 for an extended period of time. In an embodiment, the power provided by the batteries may be the sole source of power used to operate the life safety device 20. However, in other embodiments, the battery power may be supplemental to the remote power source, for example in the event of a failure or loss of power at the power source.

In an embodiment, a sound generation mechanism 34 is connected to the printed circuit board 30 within the housing 22. The sound generation mechanism 34 is operable to receive power from the printed circuit board 30 to generate a noise in response to detection of a condition. In addition, one or more actuatable mechanisms 36, such as a button for example, is connected to the printed circuit board 30 and is received within an opening formed in the lower housing portion 26. The actuatable mechanism 36 may be configured to perform one or more functions of the life safety device 20 when actuated. Examples of operations performed via the actuatable mechanism 36 include, but are not limited to, a press to test function, a smoke alarm "hush", a low battery "hush", and end of life "hush," radio frequency enrollment of additional life safety devices 20 such as in a detection system including a plurality of life safety devices configured to communicate with one another wirelessly, and to reset the unit once removed from its packaging. Although the actuatable mechanism 36 is shown positioned at the center of the lower housing portion 26, embodiments where the actuatable mechanism 36 is located at another location about the housing 22 are also within the scope of the disclosure.

The life safety device 20 additionally includes one or more components that define an optical chamber assembly 40 within the interior of the housing 22. The optical chamber assembly 40 is generally open to the area surrounding the life safety device 20 and is thus receptive of ambient materials through one or more openings. The ambient materials may include air as well as smoke and non-smoke particles that are carried by the air.

With reference now to FIGS. 3-8, the optical chamber assembly 40 of the life safety device 20 is illustrated and described in more detail. As shown, the optical chamber assembly 40 is defined by a plurality of coupled components. A first or bottom component of the optical chamber assembly 40 includes a light ring 42 configured to receive and couple one or more light devices to the printed circuit board 30. As shown, the light ring 42 may have a body 44 that is generally circular in shape and includes at least one base 46 protruding outwardly from the light ring 42. The one or more bases 46 may be integrally formed with or may be connectable to body 44 of the light ring 42. In the illustrated non-limiting embodiment, the light ring 42 includes three separate bases 46 disposed at various locations about a periphery of the light ring 42. However, it should be understood that a light ring 42 having any number of bases 46 is contemplated herein. Each base 46 may include an inner surface 47 (shown in an exemplary embodiment in FIG. 5) having a shape complementary to the light device received thereon. Further, an opening 49 may be formed in each base 46 through which one or more connectors of a light device may extend for connection to the printed circuit board 30.

Figure 4:
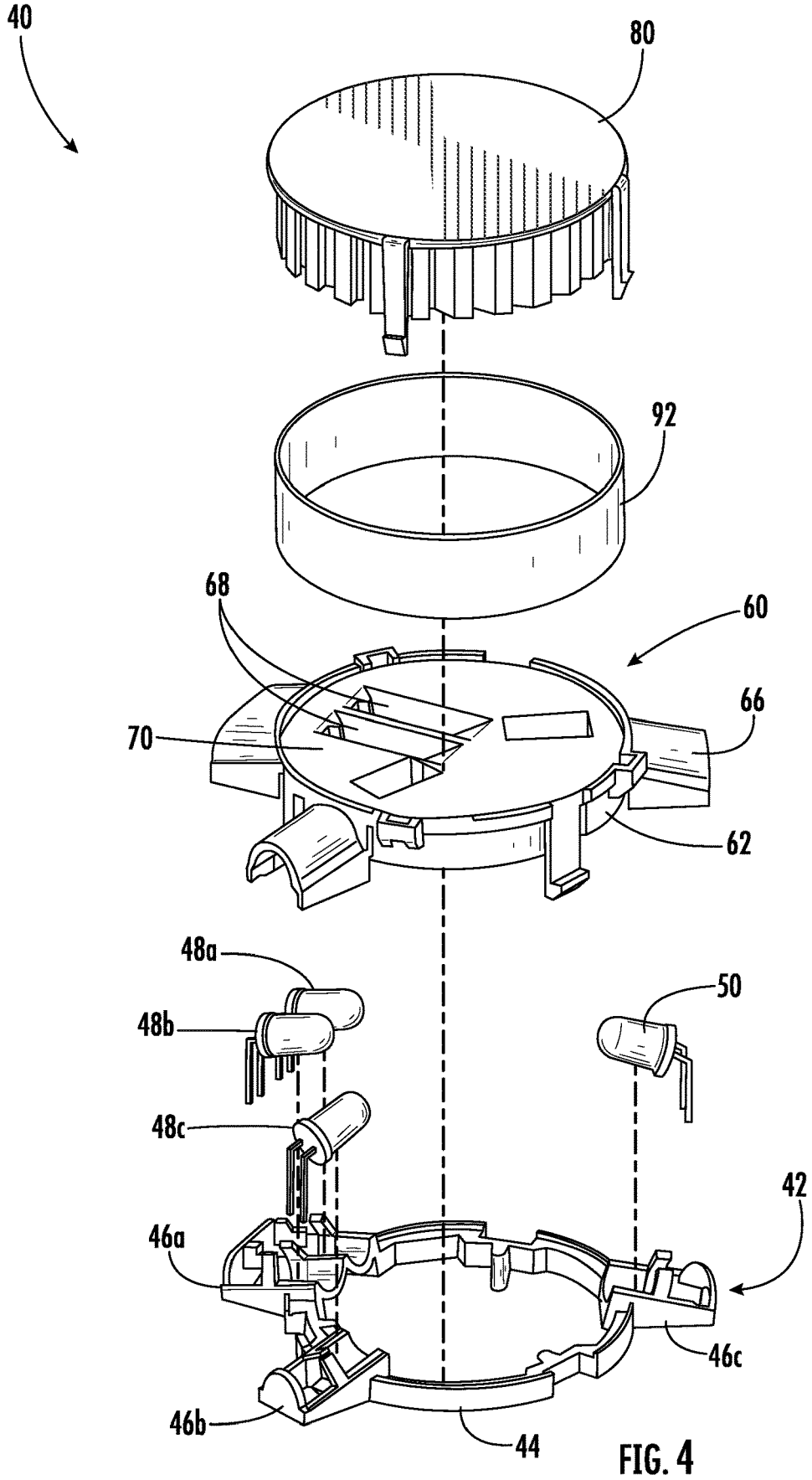
FIG. 4 is an exploded perspective view of an optical chamber assembly of a life safety device according to an embodiment.
Figure 5:
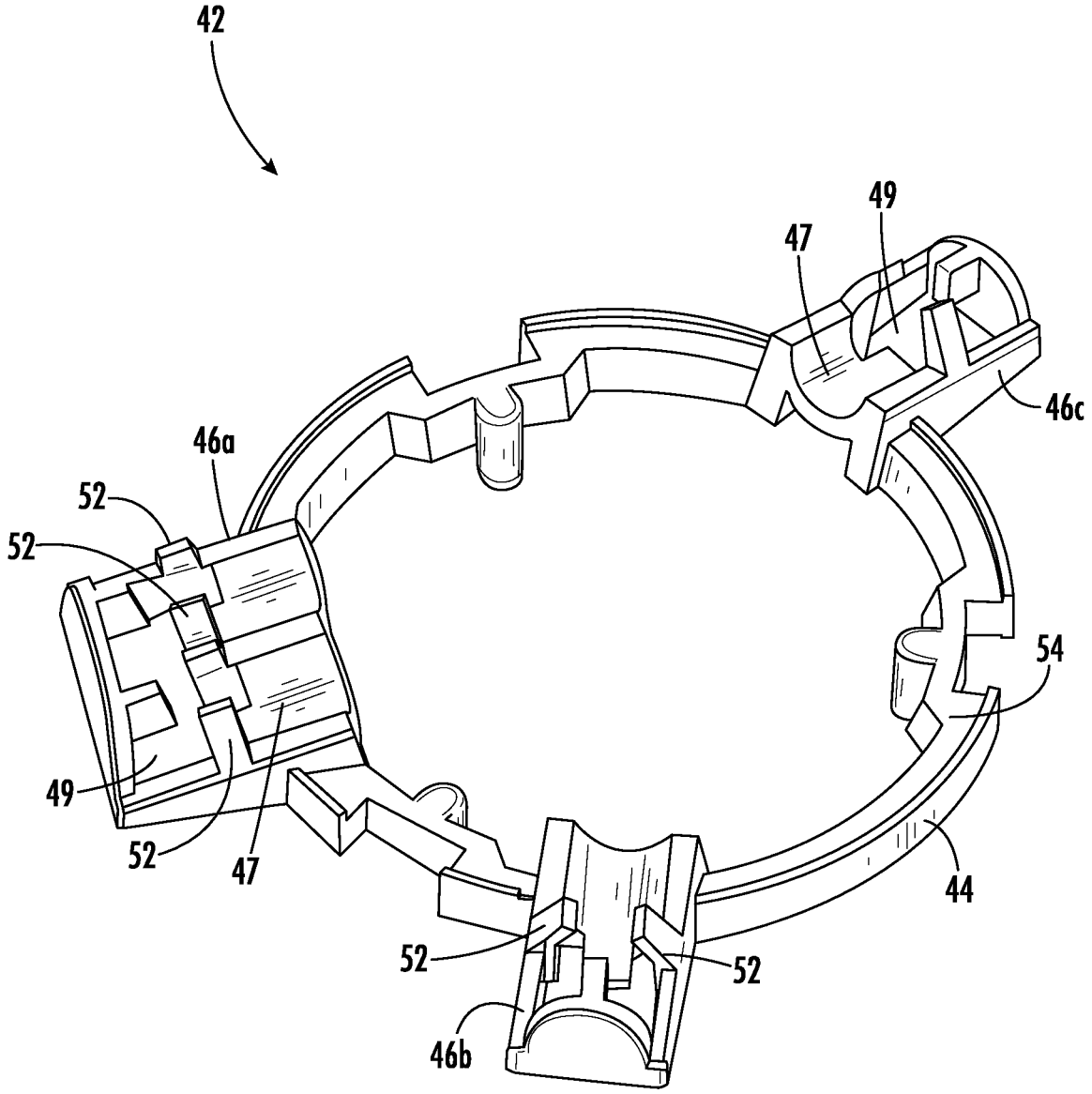
FIG. 5 is a perspective view of a light ring of the optical chamber assembly of FIG. 4 according to an embodiment.

In the illustrated, non-limiting embodiment of FIGS. 4-5, light ring 42 includes a first base 46*a* for receiving both a first light source 48*a* and a second light source 48*b*, such as light emitting diodes for example. Although both light sources 48*a*, 48*b* are coupled to a single base 46*a*, in other embodiments, each light source 48*a*, 48*b* may be mounted to a distinct base 46. The first light source 48*a* and the second light source 48*b* may be selected to emit light having different wavelengths. For example, the first light source 48*a* may emit a first color light and the second light source 48*b* may emit a second, distinct color light. Alternatively, the first light source 48*a* may emit a first light within a visible spectrum and the second light source 48*b* may emit a second light outside of the visible spectrum, such as infrared light for example. In an embodiment, a second base 46*b* of the light ring 42 is configured to support a third light source 48*c*. The third light source 48*c* may be arranged at an angle to the light emitted by the first and second light sources 48*a*. 48*b* and may emit light having the same wavelength or a different wavelength than the first and second light sources 48*a*, 48*b*. A third base 46*c* may be adapted to receive a light receiver 50. Although three light sources and a single receiver are described herein, it should be understood that any number of light sources including a single lights source, two light sources, and more than three light sources and any number of receivers are also within the scope of the disclosure. In an embodiment, each base 46 includes one or more arms 52 extending outwardly therefrom to restrict movement of the light source 48 or light receiver 50 coupled thereto relative to the base 46, such as in the event that the life safety device 20 is dropped for example.

The light receiver 50 is disposed to receive light that is emitted by one of the light sources 48*a*, 48*b*, 48*c* and that is then reflected from a chamber (not shown) within the optical chamber assembly 40 by the ambient materials toward the light receiver 50 along a light receiving axis of the light receiver 50. The light receiver 50 may be provided as any suitable photoelectric light receiving element and is configured to generate an output electric signal in accordance with light being received. That is, for light that is emitted by the first light source 48*a*, reflected by the ambient materials in the chamber and then received by the light receiver 50 along the light receiving axis, the light receiver 50 generates a first output signal. Similarly, for light that is emitted by the second and third light sources 48*b*, 48*c*, reflected by the ambient materials in the chamber and then received by the light receiver 50 along the light receiving axis, the light receiver 50 generates a second and third output signal, respectively. It should be understood that in addition to each of the light sources 48*a*, 48*b*, 48*c* being arranged at an angle relative to the light receiver 50, each of the bases may be oriented such that the corresponding light source 48*a*, 48*b*, 48*c*, or light receiver 50 mounted therein is arranged at a desired angle relative to the horizontal plane defined by the light ring 42.

A light cover 60 may be adapted to mount in overlapping relationship with the light ring 42. In an embodiment, the light cover 60 includes an at least partially solid body 62 including a sidewall 63. In an embodiment, the shape of the sidewall 63 is generally complementary to the shape of the light ring 42, for example, both the light ring 42 and the sidewall 63 may be generally annular or ring-shaped. As a result, at least a portion of the sidewall 63 of the light cover 60 may be disposed in vertical alignment with an upper surface 54 of the light ring 42 (shown in FIG. 5).

The light cover 60 may include one or more covers 66 protruding outwardly from the exterior of the component body 62. Each of these covers 66 may have a size corresponding to one of the bases 46 such that each cover 66 at least partially surrounds, or in some embodiments encases, a respective base 46 of the light ring 42. The positioning of the covers 66 may be intended to block or limit ambient light from interacting with and affecting the light emitted and received by the light devices 48, 50.

In the illustrated, non-limiting embodiment, one or more openings 68 are formed in an upper surface 70 of the body 62. Each opening 68 may correspond to a light source 48 or light receiver 50 and may be substantially aligned therewith such that each light device 48, 50 is in optical communication with an area disposed adjacent the upper surface 70 of the light cover 60 via the openings 68.

The light cover 60 may be configured to removably affix to the printed circuit board 30, such as via a snap fit connection for example. In the illustrated, non-limiting embodiment, one or more resilient tabs 72 protrude from a portion of the body 62 of the light cover 60, such as the sidewall 63 for example, and are receivable within corresponding openings 74 (see FIG. 2) formed in the printed circuit board 30. Because the light ring 42 is disposed between the light cover 60 and the printed circuit board 30, this connection between the tabs 72 and the circuit board 30 may restrict movement of the light ring 42 relative to the circuit board 30. However, it should be understood that the engagement described herein is intended as an example only and any suitable mechanism for attaching the light cover 60 and/or the light ring 42 to one another and/or to the printed circuit board 30 is contemplated herein.

In the illustrated, non-limiting embodiment of FIGS. 3-4 and 7-8, the optical chamber assembly 40 additionally includes an optical cover 80 mounted in overlapping arrangement with the light cover 60. In an embodiment, a contour of an exterior of the optical cover 80 is generally complementary to the light cover 60. However, embodiments where the optical cover 80 has a different shape than the light cover 60 are also within the scope of the disclosure.

As shown, the optical cover 80 may include an end piece 82 and a plurality of individual side members 84 connected to and arranged at an angle relative to the end piece 82. In the illustrated, non-limiting embodiment, each of the plurality of side members 84 is substantially identical in shape and the side members 84 are spaced equidistantly about the periphery of the end piece 82. The side members 84 may be generally labyrinth-like in shape are offset from one another by a distance such that a small, non-linear clearance 86 is formed between adjacent side members 84. Each of these clearances 86 allows ambient air and any particles trapped therein to flow from outside the cover 80 into the interior chamber 88 of the cover 80 defined between the plurality of side members 84 and the adjacent surface 70 of the light cover 60. The labyrinth arrangement is intended to allow a flow of ambient air through the side members 84 while maximizing the blockage of stray light by limiting any direct light path to the photodiode from outside sources.

The optical cover 80 may be configured to removably affix to the light cover 60. In the illustrated, non-limiting embodiment, one or more resilient tabs 90 protrude downwardly from the optical cover 80. These tabs 90 are receivable within corresponding openings 76 formed in the light cover 60, as shown in FIG. 11. The tabs 90 and openings 76 illustrated and described herein for affixing the cover to the light cover are intended as an example only and any suitable mechanism for attaching the cover and light cover is contemplated herein.

Figure 6:
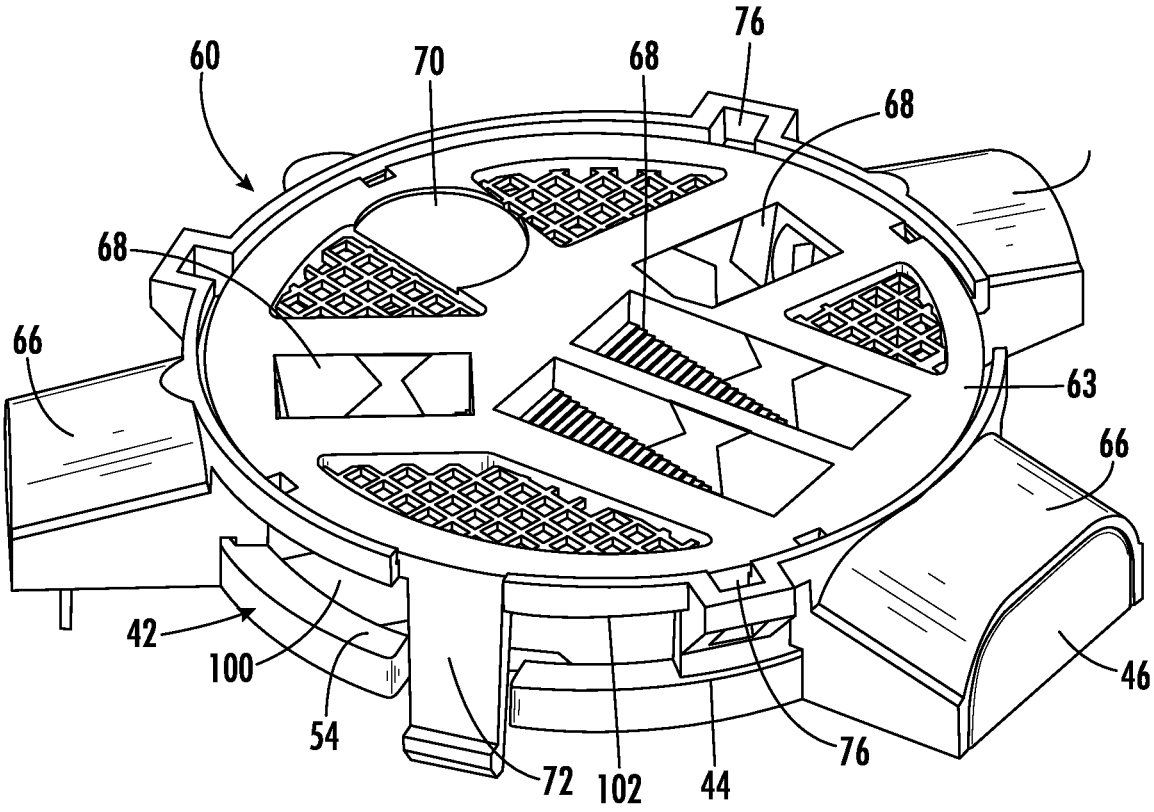
FIG. 6 is a perspective view of an optic cover of the optical chamber assembly of FIG. 3A according to an embodiment.
Figure 7:
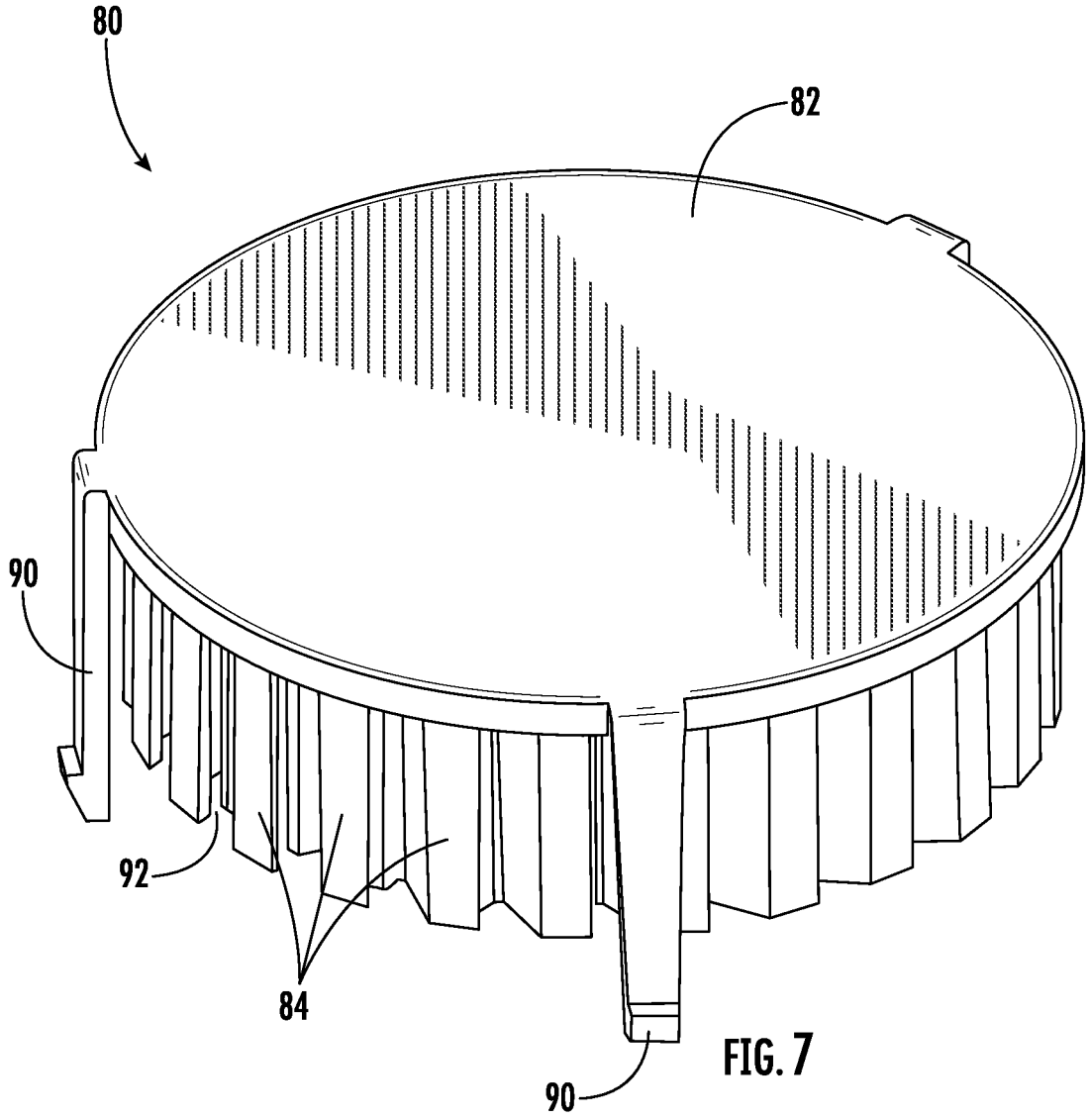
FIG. 7 is a perspective view of an optical cover of the optical chamber assembly of FIG. 3A according to an embodiment.
Figure 8:
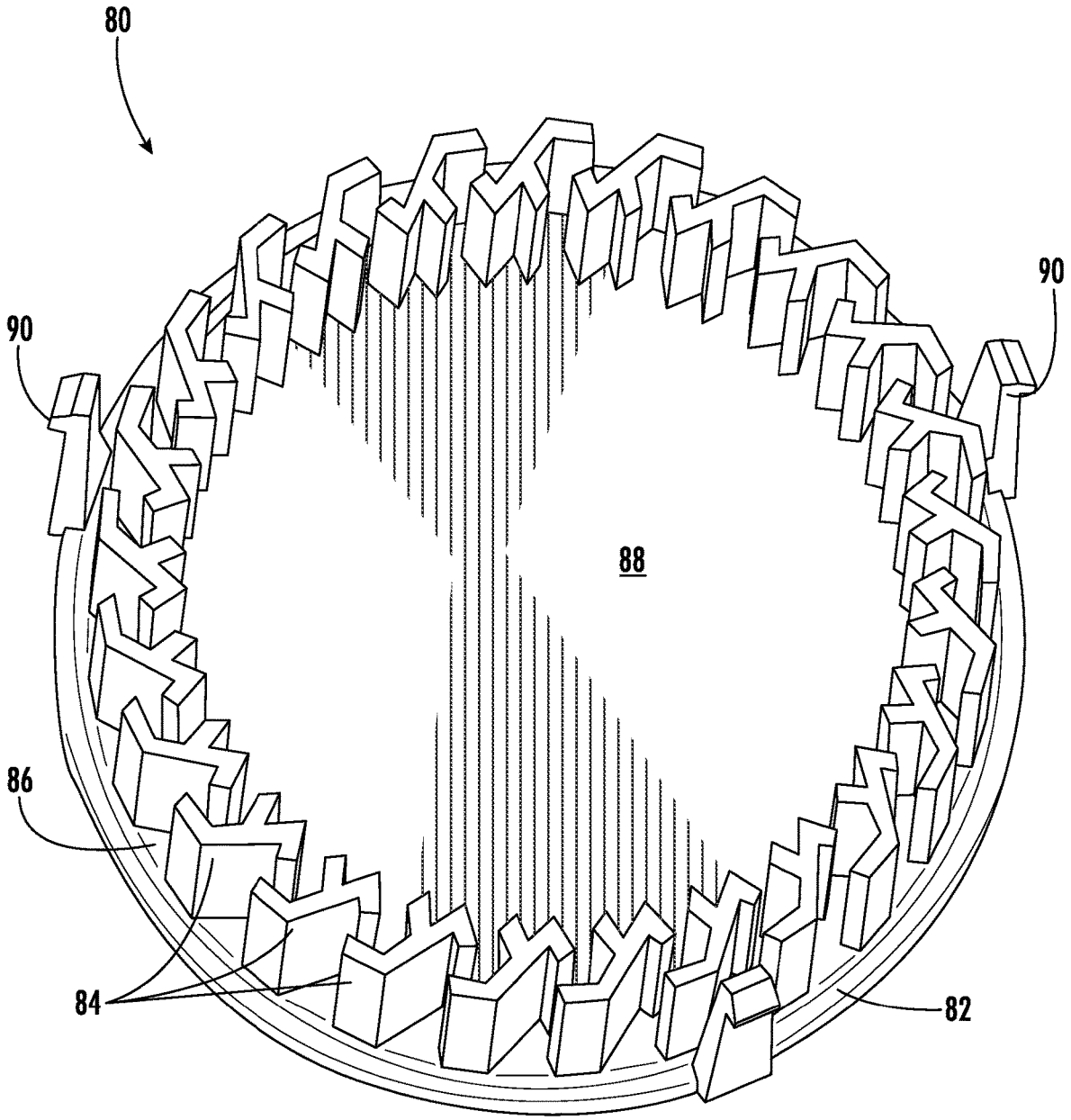
FIG. 8 is a bottom perspective view of the optical cover of FIG. 7 according to an embodiment.

In an embodiment, as shown in FIG. 4, the optical chamber assembly 40 may additionally include a screen 92 or other similar component to prevent bugs (which may interfere with the proper function of the life safety device 20) from entering the chamber 88 defined between the side members 84 and the upper surface 70 of the light cover 60. In an embodiment, the screen 92 is wrapped about an exterior surface of the plurality of side members 84. However, in other embodiments, the screen 92 may be affixed to an interior surface of the plurality of side members 84. Alternatively, or in addition, as best shown in FIG. 6, the screen 92 may be affixed to a portion of the light cover 60, such as within one or more fluid openings formed in the body 62 for example. Accordingly, depending on the point of entry of the air being sampled within the chamber 88, the air may, but need not pass through the screen 92 prior to entering the chamber 88.

As described herein, air and smoke entrained therein is typically provided to the chamber 88 via the passageways or clearances 86 defined between adjacent side members 84 of the optical cover 80, which form a primary smoke entry location. However, to enhance the concentration of smoke provided to the chamber 88, in an embodiment, the life safety device 20 includes at least one additional or secondary smoke entry location arranged in fluid communication with the chamber 88. The at least one additional smoke entry location may be formed by an opening 100 arranged adjacent an outer aspect of the optical chamber assembly 40. In an embodiment, at least one opening 100 is defined adjacent the light cover 60. As best shown in FIG. 6, when the light cover 60 is mounted relative to the light ring 42, an opening 100 is arranged at the side of the optical chamber assembly 40, at the interface between the light cover 60 and the light ring 42. The one or more openings 100 may be defined at a position about the light cover 60 between pairs of adjacent covers 66. It should be understood that a single opening 100 or multiple openings may be defined between a single pair of adjacent covers 66. Alternatively, or in addition, one or more openings 100 may be formed between each pair of covers 66, respectively.

In the illustrated, non-limiting embodiment, at least a portion of the end surface 102 of the sidewall 63 adjacent to the light ring 42 is offset from the upper surface 54 of the light ring 42 such that the opening 100 is defined therebetween. For example, an axial length of the sidewall 63 directly adjacent the cover 66 may be greater than the axial length of a sidewall 63 at a central location between covers 66 such that the opening 100 is spaced from the covers 66. Accordingly, in an embodiment, the size and shape of the opening 100 may be defined at least in part by the configuration of the sidewall 63. Although a vertical offset between the end surface 102 of the sidewall 63 and the upper surface 54 of the light ring 42 is illustrated in the FIGS., to define the opening 100, embodiments where the end surface 102 of the sidewall 63 is additionally or alternatively horizontally offset from the upper surface 54 of the light ring 42 are also contemplated herein.

In another embodiment, the substantial entirety of the end surface 102 of the sidewall 63 is aligned and in direct contact with the upper surface 54 of the light ring 42 when the light cover 60 and the light ring 42 are coupled to one another. In such embodiments, the opening 100 may be formed entirely within the sidewall 63 of the light cover 60. Further, it should be understood that in any of the embodiments disclosed herein the one or more openings 100 may be defined as a cutout or absence of material, or alternatively, may be defined by an area containing a porous or permeable material, such as a mesh material having a plurality of openings formed therein.

In another embodiment, an opening 100 defining an additional smoke entry location about the life safety device 20 is formed about the optical cover 80. For example, one or more of the plurality of side members 84 may be offset from the end piece 82, such that an opening 100 is defined there between. Alternatively, or in addition, an opening 100 may be defined between an end of one or more of the side members 84 configured to contact the upper surface 70 of the light cover 60. In an embodiment, the axial height of any of the openings 100 is less than or equal to about 0.050 inches. In another embodiment, the axial height of the openings 100 is greater than about 0.1 inches, 0.15 inches, and in some embodiments 0.18 inches. However, larger or smaller openings 100 are also within the scope of the disclosure.

By increasing the number of smoke entry points about the life safety device 20, a higher concentration of smoke will enter the chamber 88 and therefore smoke detection is enhanced. Further, by positioning the additional smoke entry points about the outer periphery of the optical smoke chamber, the additional smoke entry point are configured to minimize the stray light emitted into the chamber 88 from external sources.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An optical chamber assembly of a life safety device, the optical chamber assembly comprising:

a light ring for supporting at least one light device;

an optical cover defining an interior chamber of the optical chamber assembly, the optical cover comprising a plurality of side members spaced from one another to define a plurality of smoke flow paths connected to the interior chamber; and a light cover disposed between the light ring and the optical cover, wherein the light cover optically couples the at least one light device with the interior chamber;

a primary smoke entry location defined by at least one of the plurality of smoke flow paths in the optical cover; and a secondary smoke entry location distinct from the primary smoke entry location, the secondary smoke entry location being arranged in fluid communication with the interior chamber.

2. The optical chamber assembly of claim 1, wherein the secondary smoke entry location is arranged at an outer aspect of the optical chamber assembly.

3. The optical chamber assembly of claim 1, wherein the secondary smoke entry location is defined by an opening.

4. The optical chamber assembly of claim 3, wherein the opening is formed between at least one of the plurality of side members and a surface of the light cover.

5. The optical chamber assembly of claim 3, wherein the optical cover further comprises an end piece and the opening is formed between at least one of the plurality of side members and the end piece.

6. The optical chamber assembly of claim 3, wherein the light cover includes a body having a sidewall and the opening is formed within the sidewall.

7. The optical chamber assembly of claim 3, wherein the opening is formed between a portion of the light cover and the light ring.

8. The optical chamber assembly of claim 7, wherein the light cover includes a body having a sidewall and the light ring includes a ring body, the opening being formed between a portion of the sidewall of the light cover that is offset from an adjacent surface of the ring body.

9. The optical chamber assembly of claim 1, wherein the at least one light device includes a light source and a light receiver.

10. The optical chamber assembly of claim 1, wherein the optical chamber assembly is mounted to a printed circuit board and the light cover removably couples the light ring directly to the printed circuit board.

11. The optical chamber assembly of claim 1, wherein the optical cover is connected to the light cover via a snap fit connection.

12. A life safety device comprising:

a printed circuit board;

an optical chamber assembly connected to the printed circuit board, the optical chamber assembly comprising a primary smoke entry location and a secondary smoke entry location distinct from the primary smoke entry location;

at least one light device for evaluating particles within the inside the optical chamber assembly;

a light ring for supporting the at least one light device;

an optical cover defining an interior chamber of the optical chamber assembly, and a light cover disposed between the light ring and the optical cover, wherein the light cover optically couples the at least one light device with the interior chamber.

13. The life safety device of claim 12, wherein the secondary smoke entry location is arranged about an outer aspect of the optical chamber assembly.

14. The life safety device of claim 12, wherein the optical cover further comprises a plurality of side members spaced from one another to define a plurality of smoke flow paths connected to the interior chamber and the primary smoke entry location is defined by at least one of the plurality of smoke flow paths.

15. The life safety device of claim 14, wherein the secondary smoke entry location is defined by an opening formed between at least one of the plurality of side members and a surface of the light cover.

16. The life safety device of claim 14, wherein the optical cover further comprises an end piece and the secondary smoke entry location is defined by an opening formed between at least one of the plurality of side members and the end piece.

17. The life safety device of claim 12, wherein the light cover includes a body having a sidewall and the secondary smoke entry location is defined by an opening formed within the sidewall.

18. The life safety device of claim 12, wherein the secondary smoke entry location is defined by an opening formed between a portion of the light cover and the light ring.

19. The life safety device of claim 12, wherein the secondary smoke entry location is defined by an opening, and the opening includes a mesh material.

* * * * *